US010337301B2

(12) United States Patent
Harive

(10) Patent No.: US 10,337,301 B2
(45) Date of Patent: Jul. 2, 2019

(54) MITIGATED DYNAMIC UNDERBALANCE

(71) Applicant: HALLIBURTON ENERGY SERVICES, INC., Houston, TX (US)

(72) Inventor: Kevin Scott Harive, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/544,505

(22) PCT Filed: Feb. 13, 2015

(86) PCT No.: PCT/US2015/015954

§ 371 (c)(1),
(2) Date: Jul. 18, 2017

(87) PCT Pub. No.: WO2016/130162

PCT Pub. Date: Aug. 18, 2016

(65) Prior Publication Data

US 2018/0016879 A1 Jan. 18, 2018

(51) Int. Cl.

| | |
|---|---|
| ***E21B 43/1185*** | (2006.01) |
| ***E21B 43/119*** | (2006.01) |
| ***E21B 43/117*** | (2006.01) |
| ***E21B 47/06*** | (2012.01) |

(52) U.S. Cl.

CPC ..... *E21B 43/1185* (2013.01); *E21B 43/117* (2013.01); *E21B 43/119* (2013.01); *E21B 47/06* (2013.01)

(58) Field of Classification Search

CPC ..... E21B 43/1185
USPC ..... 175/4.57
See application file for complete search history.

(56) References Cited

U.S. PATENT DOCUMENTS

| | | | |
|---|---|---|---|
| 4,496,009 | A | 1/1985 | DerMott et al. |
| 4,798,244 | A | 1/1989 | Trost |
| 4,823,875 | A | 4/1989 | Hill |
| 5,295,545 | A | 3/1994 | Passamaneck |
| 7,073,589 | B2 | 7/2006 | Tiernan et al. |
| 7,409,992 | B2 | 8/2008 | Zazovsky et al. |
| 7,913,603 | B2 | 3/2011 | LaGrange et al. |
| 7,913,761 | B2 | 3/2011 | Pratt et al. |
| 8,033,333 | B2 | 10/2011 | Frazier et al. |

(Continued)

OTHER PUBLICATIONS

Korean Intellectual Property Office, International Search Report and Written Opinion, dated Oct. 26, 2015, 17 pages, Korea.

(Continued)

*Primary Examiner* — Taras P Bemko

(57) ABSTRACT

A perforating gun assembly for use in a wellbore includes a carrier body and a charge holder disposed within the carrier body. One or more shaped charges are supported by the carrier body and are operably coupled to a detonator for igniting a highly explosive material within the each of the shaped charges. At least one solid propellant tablet is also disposed within the carrier body and is operably coupled to the detonator to ignite and burn immediately after detonation of the shaped charges. The solid propellant tablet burns or is consumed in such a manner to effectively mitigate or control the dynamic underbalance created by the free volume within the carrier body. Burning of the solid propellant tablet may increase the pressure within the carrier body to a level lower than a hydrostatic pressure around the carrier body in the wellbore such that a dynamic underbalance is maintained.

20 Claims, 5 Drawing Sheets

(56) References Cited

U.S. PATENT DOCUMENTS

| | | | |
|---|---|---|---|
| 8,079,296 | B2 | 12/2011 | Barton et al. |
| 8,342,094 | B2 | 1/2013 | Marya et al. |
| 8,522,863 | B2 | 9/2013 | Tiernan et al. |
| 8,714,252 | B2 | 5/2014 | Glenn et al. |
| 8,807,003 | B2 | 8/2014 | Le et al. |
| 2004/0089449 | A1 | 5/2004 | Walton et al. |
| 2005/0236183 | A1 | 10/2005 | Grove et al. |
| 2009/0183916 | A1 | 7/2009 | Pratt et al. |
| 2012/0181026 | A1 | 7/2012 | Le et al. |
| 2013/0008655 | A1 | 1/2013 | Le et al. |

OTHER PUBLICATIONS

Baker Hughes, Propellant-Assisted Stimulation Increased Production in Middle East Well, StimGun Propellant-Assisted Perforating System, Nov. 17, 2012, Retrieved from: http://www.bakerhughes.com/products-and-services/completions/well-completions/tubing-conveyed-perforating-tcp-systems/stimgun-propellant-assisted-perforating-system.

Weatherford International, Kodiak Enhanced Perforating System, Sep. 1, 2017, 6 pages.

B.Grove, J.Harvey, and L.Zhan, Perforation Cleanup via Dynamic Underbalance: New Understandings, Jun. 7-10, 2011, 11 pages, SPE 143997, Society of Petroleum Engineers, SPE European Formation Damage Conference, Noordwijk, The Netherlands.

MITIGATED DYNAMIC UNDERBALANCE

CROSS-REFERENCE TO RELATED APPLICATIONS

This application is a U.S. national stage patent application of International Patent Application No. PCT/US2015/015954 filed on Feb. 13, 2015 the benefit of which is claimed and the disclosure of which is incorporated herein by reference in its entirety.

BACKGROUND

1. Field of the Invention

The present disclosure relates generally to systems, tools and associated methods utilized in conjunction with hydrocarbon recovery wells. More particularly, embodiments of the disclosure relate managing a down-hole pressure differential, which occurs during perforating operations.

2. Background Art

Often, in subterranean wellbores drilled in connection with exploration or the recovery of hydrocarbons, a number of tubular casing members are installed in the wellbore to prevent collapse of the wellbore wall and to manage fluid communication between the wellbore and a surrounding geologic formation. Conventionally, the casing members are cemented within the wellbore, and thus, to pass fluids between an interior of the casing members and the geologic formation, perforations are often formed through the casing members, through the cement and a short distance into the geologic formation. Typically, these perforations are created by detonating a series of explosive shaped charges within the wellbore. In some instances, the shaped charges are loaded into one or more perforating guns at a surface location, and then the perforating guns are lowered down-hole on a conveyance such as a tubing string, wire line, slick line, coil tubing, etc.

The perforating guns may include an outer canister in which the shaped charges are packed. The outer canister can be sealed at the surface location, thereby capturing atmospheric gasses at an ambient surface pressure within a "free volume" defined in the outer canister, e.g., the empty space between the shaped charges. Upon detonation of the shaped charges within the wellbore, detonation gasses fill the canister and the interior pressure may rise to tens of thousands of psi within microseconds. Holes created in the canister by the shaped charges permit the detonation gasses to exit the canister, leaving the free volume in the canister substantially empty. Then the free volume rapidly fills with wellbore fluids and formation fluids.

The transient pressure differential generated as the free volume fills with wellbore fluid may be referred to as a "dynamic underbalance." In some instances a dynamic underbalance is beneficial. For example, it has been found that the dynamic underbalance may help clean perforation tunnels of debris as formation fluids flow through the tunnels toward the free volume. However, in some instances, an excessive dynamic underbalancemay be detrimental. For example an excessive dynamic underbalance may cause damage to the perforating gun, conveyance tubing, packers set in the wellbore or other down-hole equipment as wellbore fluids rush into the free volume. An excessive dynamic underbalance may also cause damage to the perforation tunnels, e.g., by sanding, as sand is carried into the perforation tunnels by formation fluids rushing through the perforation tunnels toward the free volume. Accordingly, a need has arisen for an apparatus and method that manage a dynamic underbalance to provide for safe and effective perforation of a wellbore.

BRIEF DESCRIPTION OF THE DRAWINGS

The disclosure is described in detail hereinafter on the basis of embodiments represented in the accompanying figures, in which.

DETAILED DESCRIPTION

Figure 1:
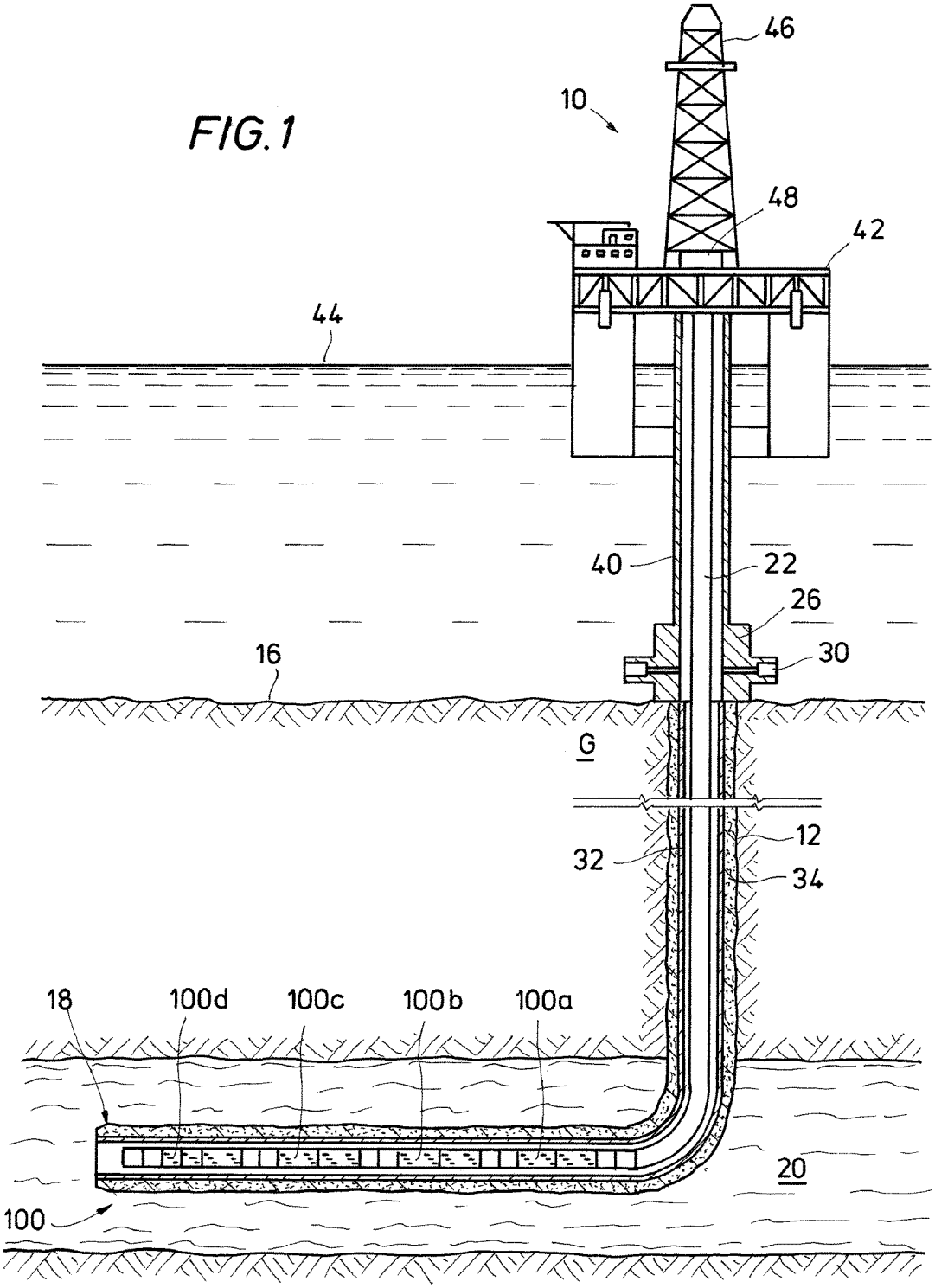
FIG. 1 is a partially cross-sectional schematic view of a well system including schematic illustration of an offshore oil and gas platform operating a plurality of perforating gun assemblies positioned within a tool string of the present invention in accordance with example embodiments of the present disclosure.

In the interest of clarity, not all features of an actual implementation or method are described in this specification. Also, the "exemplary" embodiments described herein refer to examples of the present invention. In the development of any such actual embodiment, numerous implementation-specific decisions may be made to achieve specific goals, which may vary from one implementation to another. Such would nevertheless be a routine undertaking for those of ordinary skill in the art having the benefit of this disclosure. Further aspects and advantages of the various embodiments and related methods of the invention will become apparent from consideration of the following description and drawings.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "below," "lower," "above," "upper," "uphole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 illustrates a well system 10 in accordance with example embodiments of the present disclosure. In well system 10, a wellbore 12 extends from a seabed 16 through a geologic formation "G." Although well system 10 is illustrated in an offshore context, one skilled in the art will recognize that aspects of the disclosure may be practiced in terrestrial applications as well. Wellbore 12 includes a portion 18 thereof that extends through a hydrocarbon producing formation 20. Although the portion 18 of the wellbore 12 that intersects the hydrocarbon producing formation 20 is depicted as being substantially horizontal, it should be understood that the orientation of this portion 18 of the wellbore 12 is not essential to the principles of this disclosure. The portion 18 of the wellbore 12 which intersects the hydrocarbon producing formation 20 could be otherwise oriented (e.g., vertical, inclined, etc.). A work string 22 including a plurality of perforating guns 100, extends into the wellbore 12 such that perforating guns 100 are disposed within the portion 18 of the wellbore 12 extending through the hydrocarbon bearing formation 20 in accordance with exemplary embodiments of the disclosure. Work string 22 includes four perforating guns 100*a*, 100*b*, 100*c* and 100*d* (collectively or generically referred to as 100), although more or fewer perforating guns 100 may be provided. As illustrated, a first perforating gun 100*a* is disposed at a first down-hole location at an up-hole end of portion 18 of wellbore 12 and a second perforating gun 100*d* is disposed at a second down-hole location at a down-hole end of portion 18 of wellbore 12.

The well system 10 includes a wellhead installation 26 on seabed 16, which provides pressure seals and other interfaces for the work string 22 and other tools extending into the wellbore 12. The wellhead installation 26 supports a blowout preventer 30 that is operable to contain a pressure in the wellbore 12 during sudden or unexpected pressure increases, and may also provide a suspension point for casing 32 that is cemented into the wellbore 12 with a layer of cement 34. A riser or other subsea conduit 40 extends from the wellhead installation 26 to a semi-submersible platform 42, which may float on the sea surface 44. The semi-submersible platform 42 includes a derrick 46 and a hoisting apparatus 48 for raising and lowering pipe strings such as work string 22.

When it is desired to perforate the hydrocarbon producing formation 20, work string 22 is lowered through casing 32 until the perforating guns 100 are properly positioned relative to hydrocarbon producing formation 20. Thereafter, the charges 110 (see FIG. 2) within the string of perforating guns 100 are sequentially fired, either in an up-hole to down-hole or a down-hole to up-hole direction. Charges 110 are typically shaped, such as conically, to control the direction of the blast upon detonation. In this regard, upon detonation, conically shaped charges 110 form jets that create a spaced series of perforations extending outwardly through casing 32, cement layer 34 and into hydrocarbon producing formation 20, and thereby allow formation communication between hydrocarbon producing formation 20 and wellbore 12.

Figure 2:
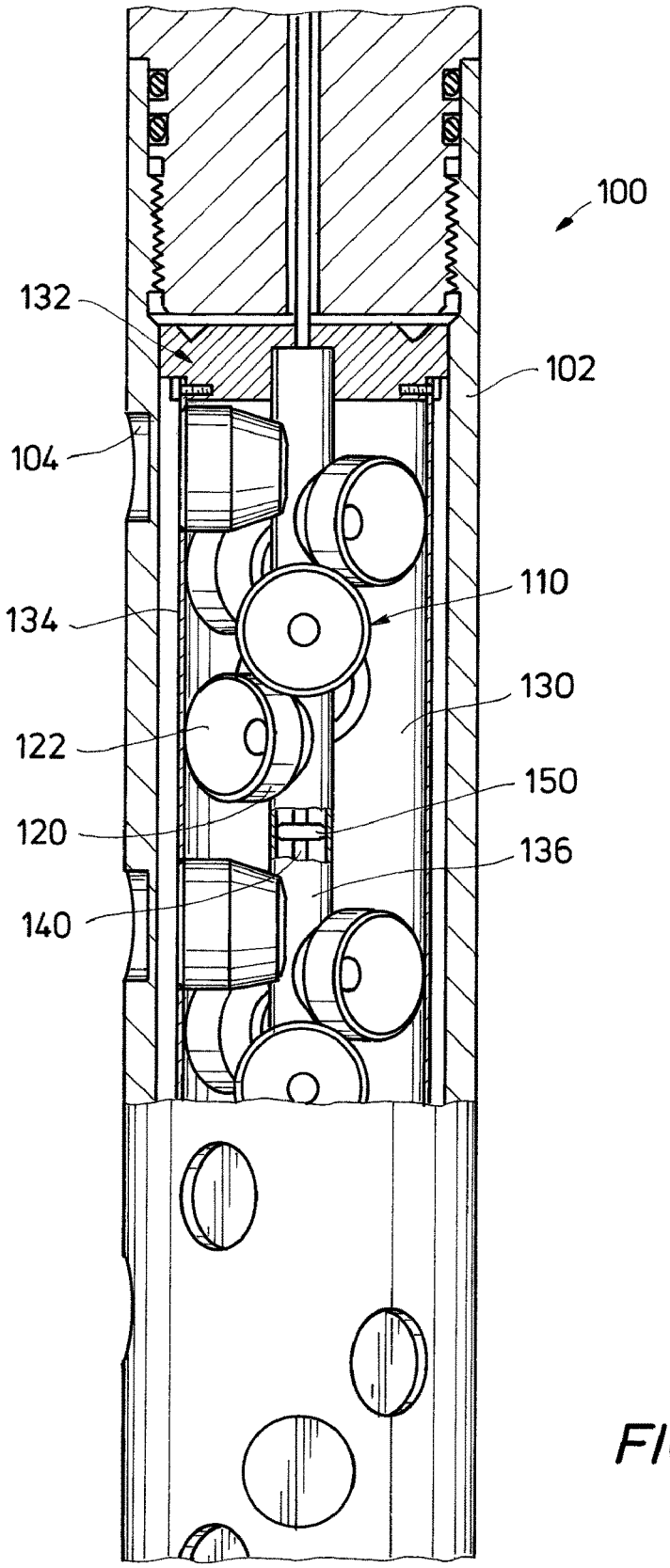
FIG. 2 is a partially cut away front view of a perforating gun assembly according to exemplary embodiments of the present disclosure.

Referring now to FIG. 2, a perforating gun 100 includes a carrier body 102 constructed of a cylindrical sleeve having a plurality of radially reduced areas depicted as scallops or recesses 104. Radially aligned with each of the recesses 104 is a respective one of a plurality of shaped charges 110, only a portion of which are visible in FIG. 2. Each of the shaped charges 110 includes an outer housing 120, and a liner 122. Disposed between each outer housing 120 and liner 122 is a quantity of high explosive. A free volume 130 is defined within the carrier body 102 in the space between the shaped charges 110.

The shaped charges 110 are retained within carrier gun body 102 by a charge holder 132 which includes an outer charge holder sleeve 134 and an inner charge holder sleeve 136. In this configuration, outer charge holder sleeve 134 supports the discharge ends of the shaped charges 110, while inner charge holder sleeve 136 supports the initiation ends of the shaped charges 110. Disposed within the inner charge holder sleeve 136 is a detonator cord 140, such as a Primacord®, which is used to detonate the shaped charges 110. In the illustrated embodiment, the initiation ends of the shaped charges 110 are positioned adjacent the central longitudinal axis of perforating gun 100 to allow detonator cord 140 to be more easily connected to the shaped charges 110 through an aperture defined at the apex of the outer housings 120 of the shaped charges 110.

Each of the shaped charges 110 is longitudinally and radially aligned with one of the recesses 104 in carrier gun body 102 when perforating gun 100 is fully assembled. In the illustrated embodiment, the shaped charges 110 are arranged in a spiral pattern such that each of the shaped charges 110 is disposed on its own level or height and is to be individually detonated so that only one shaped charge 110 is fired at a time. It should be understood by those skilled in the art, however, that alternate arrangements of shaped charges 110 may be used, including cluster type designs wherein more than one shaped charge 110 is at the same level and is detonated at the same time, without departing from the principles of the present invention.

Perforating gun 100 includes a source for creating pressurized fluid in the free volume 130 of perforating gun 100 upon detonation of the shaped charges 110. In one or more embodiments, the source may be one or more solid propellant tablets 150 disposed within the free volume 130. In other embodiments, the source may be a liquid or gel that expands when heated or a pressurized liquid. While the solid propellant tablets 150 generally are not limited to a particular shape and may be constructed in any solid geometry, and one or more embodiments, solid propellant tablets 150 may be constructed as a disc shape or as a generally flat cylindrical body having a diameter "D" (FIG. 3B) greater than a height "H" (FIG. 3B) of the solid propellant tablet 150. The solid propellant tablets 150 are operably coupled to the detonator cord 140 to be ignited thereby. As described in greater detail below, in one or more embodiments, the detonator cord 140 may pass through a central aperture 152 (FIG. 3B) defined in the propellant tablets 150 such that the ignition occurs in an interior region of the solid propellant tablets 150.

The solid propellant tablets 150 are constructed of a propellant material having known reactive properties and known pressure generation characteristics. Generally, a "propellant" material may be characterized by reactivity rates relative to the high explosive material disposed within the shaped charges 110. While detonation of the high explosive material within the shaped charges 110 may release a large amount of energy in a relatively short amount of time, the propellant material may release a large amount of energy within a relatively longer time. For example, the release of energy from the high explosive material may occur over a time span of 30 microseconds, while the release of energy from the propellant material may occur over a time span of about 30 milliseconds.

The solid propellant material may be formed from a reactive material such as a pyrophoric materials, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the solid propellant tablets 150 may be formed from the above mentioned materials in various powdered metal blends and held together with binder material as recognized in the art. These powdered metals may also be mixed with oxidizers to form exothermic pyrotechnic compositions, such as thermites. The oxidizers may include, but are not limited to, boron(III) oxide, silicon(IV) oxide, chromium (III) oxide, manganese(IV) oxide, iron(III) oxide, iron(II, III) oxide, copper(II) oxide, lead(II, III, IV) oxide and the like. The thermites may also contain fluorine compounds as additives, such as Teflon. The thermites may include nanothermites in which the reacting constituents are nanoparticles.

The reaction generated by the solid propellant tablets 150 may manifest itself through a thermal effect, a pressure effect or both. In either case, the reaction causes an increase in the pressure within perforating gun 100, the near wellbore region or both which counteracts the forces created by the dynamic underbalance condition in the wellbore 12.

Upon detonation of the shaped charges 110 in perforating guns 100, there is an initial pressure increase in the free volume 130 and near wellbore region created by the detonation gases. Simultaneously with or immediately after the detonation event, the solid propellant tablets 150 of the present invention further increase the pressure within free volume 130, the near wellbore region or both. The solid propellant tablets 150 are utilized to optimize the wellbore pressure regime by controlling the dynamic underbalance created by the free volume 130 and more specifically, by preventing excessive dynamic underbalance which may detrimentally effect the perforating operation including causing sanding of the newly formed perforations, causing undesirably large movement of the gun system and the attached work string 22 (FIG. 1), causing high tensile and compressive loads on the conveyance tubing and causing extreme pressure differentials to be applied against previously set packers both above and below the perforating interval.

Figure 3A:
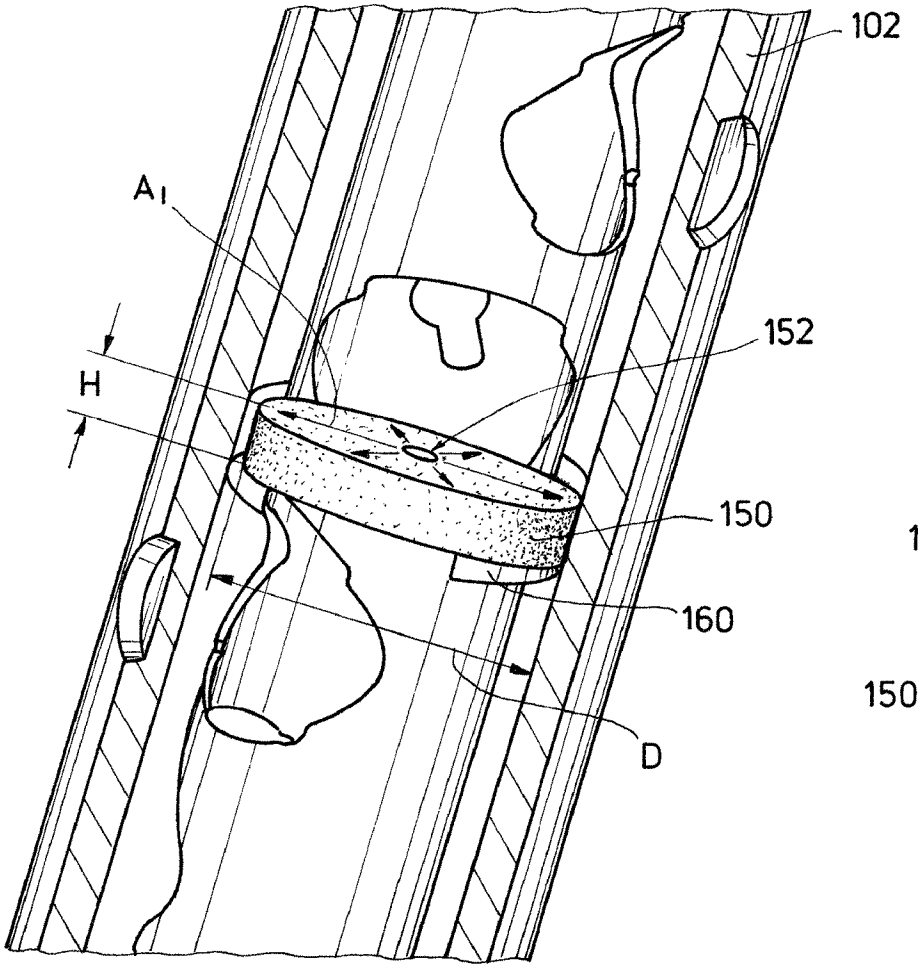
FIG. 3A is a perspective cross-sectional schematic view the perforating gun assembly of FIG. 2 with parts removed illustrating a propellant tablet disposed within a free volume of the perforating gun in accordance with example embodiments of the present disclosure.

Referring now to FIG. 3A, a solid propellant tablet 150 is disposed within the carrier body 102. In some embodiments, an outer diameter "D" of the solid propellant tablet 150 is greater than the height "H" of the solid propellant tablet 150. In one or more exemplary embodiments, as illustrated, the outer diameter "D" may be greater than a diameter of the outer charge holder sleeve 134. The solid propellant tablet 150 may be supported on a flange 160 extending radially from the outer charge holder sleeve 134, or in some embodiments, the solid propellant tablet 150 may be supported by the detonator cord 140 (FIG. 2) passing through a central aperture 152.

The central aperture 152 provides for passage the detonator cord 140 (FIG. 2), and thus defines an interior ignition point from which the solid propellant tablet 150 may be consumed upon detonation of the detonator cord 140. Upon detonation, the detonator cord 140 will likely fragment, and the solid propellant tablet 150 may be consumed generally in a radially outward direction as indicated by arrows $A_1$. By igniting the solid propellant tablet 150 in the central region, uncontrolled fragmentation of solid propellant tablet 150 may be prevented, and thus, the solid propellant tablet 150 may be consumed in a controlled manner. Consumption of the solid propellant tablet 150 in this manner maintains the fragmented solid propellant tablet 150 in a predictable size and shape as energy released. Thus the contribution of the solid propellant tablet 150 to the pressure within the carrier body 102 may be accurately planned and implemented to maintain a dynamic underbalance condition. In some exemplary embodiments, the contribution of the solid propellant tablet 150 to the pressure within the carrier body 102 may permit maintaining the pressure within the carrier body 102 less than a hysdrostatic wellbore pressure during the consumption of the propellant tablet 150.

Figure 3B:
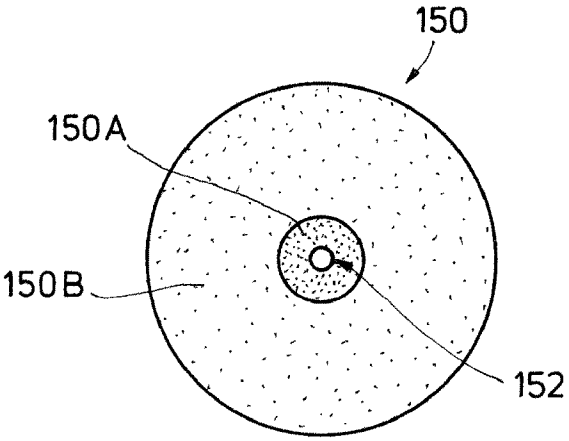
FIG. 3B is top view of the propellant tablet of FIG. 3A illustrating a plurality of propellant materials in accordance with example embodiments of the present disclosure.

Referring now to FIG. 3B, in some exemplary embodiments, a solid propellant tablet 150 may include a plurality of distinct propellant materials 150A and 150B. The distinct propellant materials are concentrically arranged such that a radially inner propellant material 150A disposed immediately around the central aperture 152 may be ignited and consumed prior to ignition and consumption of a radially outer propellant material 150B. In some embodiments, the propellant material 150A may have lower pressure generation characteristics than the propellant material 150B. Thus, the resulting pressure generation characteristics of the solid propellant tablet 150 may be induced to change at an appropriate time with respect to a pressure peak that is produced by the detonation of the shaped charges as described below.

Figure 4:
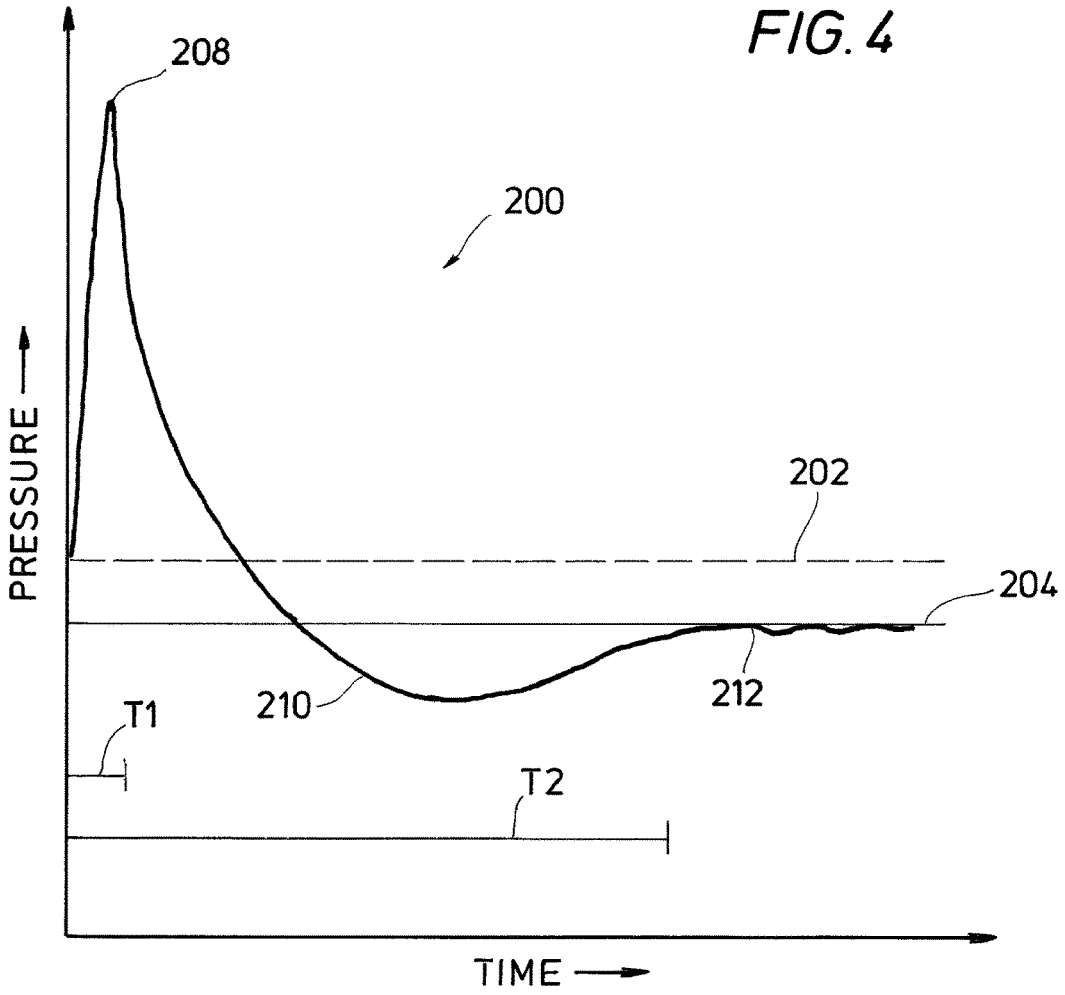
FIG. 4 is a diagrammatic view of a pressure curve generated during a perforation interval in accordance with exemplary embodiments of the present disclosure.

Referring now to FIG. 4, and with reference to FIGS. 1 and 2, a pressure versus timing graph illustrates an exemplary average pressure in a perforating interval and is generally designated 200. In some embodiments, as illustrated here, the wellbore 12 may be maintained in a static overbalanced pressure condition represented by dashed line 202 that is greater than a reservoir or formation pressure represented by solid line 204. The initial static overbalanced wellbore pressure 202 may be between about 200 psi and about 1000 psi over reservoir pressure 204. Even though a particular static overbalance pressure range has been described, other static overbalance pressures both greater than 1000 psi and less than 200 psi could also be used with the pressure invention. Likewise, even though a static overbalance pressure is depicted, the present invention could also be used in wellbore having an initial balanced pressure condition or an initial static underbalance pressure condition.

Upon detonation of the shaped charges 110 within the perforating gun an initial pressure increase is generated by the release energy from the shaped charges 110 and the solid propellant tablets 150. The high explosive in the shaped charges 110 may be consumed in a relatively short time interval $T_1$ while a pressure peak 208 is generated in the carrier body 102 and a near wellbore region. After the pressure peak 208 is produced, the energy generated by the shaped charges 110 begins to dissipate and the free volume 130 within the perforating guns 100 then generates a dynamic underbalance condition in the near wellbore region that is indicated at 210. The solid propellant tablets 150 may be consumed during time $T_2$ during the dynamic underbalance condition, and the pressure in the carrier body 102 and the near wellbore region may be maintained below the initial hydrostatic wellbore pressure 202 and/or the reservoir pressure 204 during the time interval $T_2$. A short time after detonation, the wellbore pressure stabilizes at reservoir pressure as indicated at 212. Importantly, use of the solid propellant tablets 150 of the present invention increases the pressure in the near wellbore region which may reduce both the magnitude and the duration of the dynamic underbalance condition in the near wellbore region, thereby counteracting the forces created by the dynamic underbalance condition in the wellbore and preventing an excessive dynamic underbalance condition in the wellbore 12. Time intervals $T_1$ and $T_2$ may overlap or time interval $T_2$ may follow time interval $T_1$.

Figure 5:
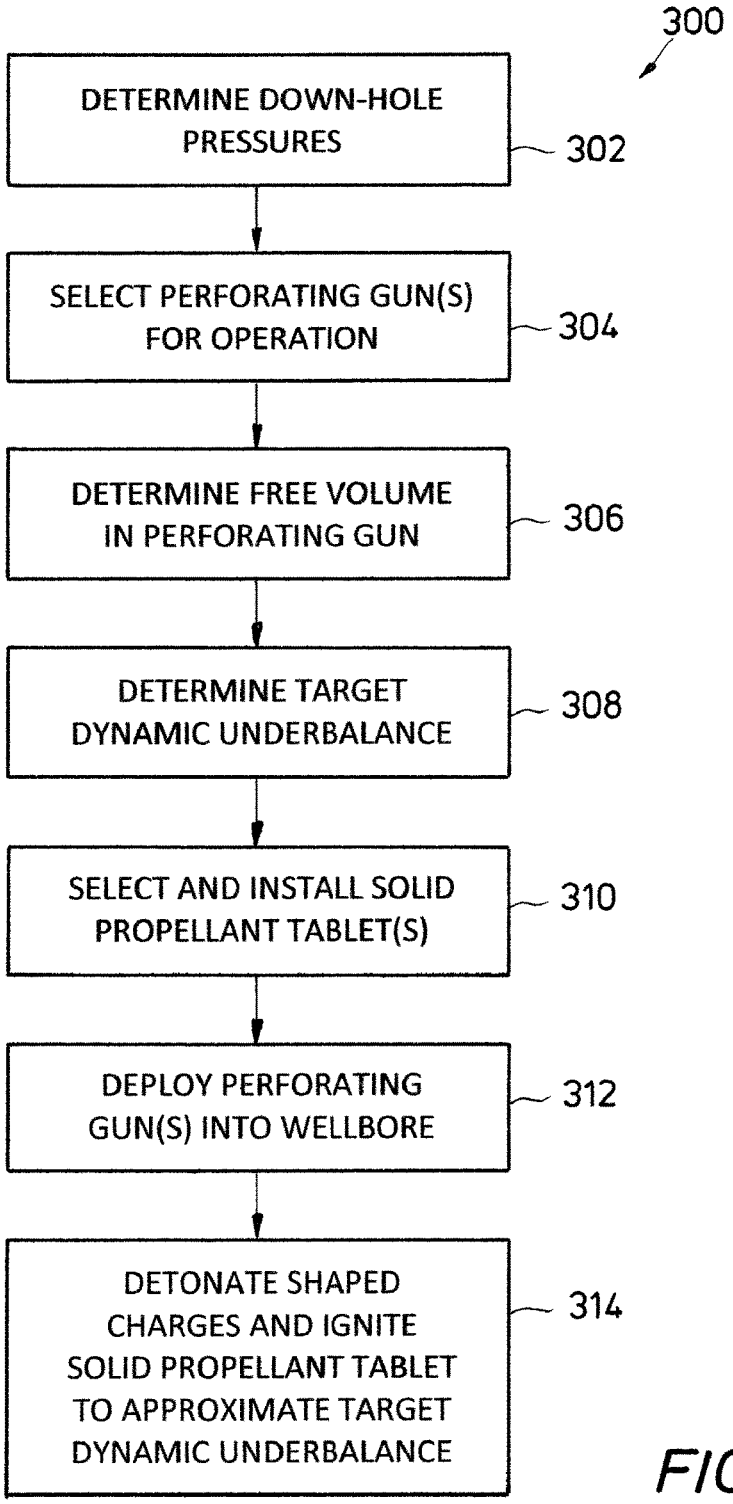
FIG. 5 is a flowchart illustrating a method of managing a dynamic underbalance by employing the solid propellant tablet of FIG. 3B in accordance with example embodiments of the present disclosure.

Referring now to FIG. 5 and with reference to FIGS. 1 and 2, some exemplary embodiments of perforating operations are illustrated whereby a perforating charge is detonated in a wellbore to form a perforation and create an underbalanced pressure condition in a free volume adjacent the location of the perforation and a pressurized fluid is released in the free volume to lessen the underbalanced pressure condition. In one or more embodiments, the pressurized fluid is released by igniting a solid propellant. In other embodiments, the pressurized fluid may be released by other means. In one or more embodiments, the pressurized fluid is a gas, while in other embodiments the pressurized fluid may be a liquid or gel. In one or more embodiments the pressurized fluid is released as the perforating charge is being detonated or immediately after detonation of the perforating charge. In any event, one or more embodiments of the foregoing perforating operations may be illustrated by operational procedure 300 shown in FIG. 5. Initially, at step 302, down-hole pressures at a desired perforation location are determined. The down-hole pressures may include a hydrostatic wellbore pressure, e.g., a pressure of wellbore fluids at the desired perforation location in addition to a formation or reservoir pressure of the hydrocarbon producing formation 20 adjacent the wellbore 12 at the desired down-hole perforation location. These pressures may be obtained by sensor data or estimated using conventional methods recognized in the art. In some exemplary embodiments, down-hole pressures at a plurality of down-hole locations may be determined. For example, down-hole pressures at a first down-hole location adjacent a first perforating gun 100*a* may be different than down-hole pressures adjacent a second perforating gun 100*b*.

Next, at step 304, a perforating gun 100 is selected to perform a perforation operation at the down-hole location. The perforating gun 100 may be a standard or existing perforating gun, and may include standard or existing shaped charges 110 therein. The perforation gun may be selected for known performance characteristics in the environmental conditions determined at step 302. In some embodiments, a plurality of perforating guns 100 is selected, e.g., for positioning at a plurality of down-hole locations determined to exhibit distinct down-hole pressures. A free volume 130 in the selected perforating gun(s) 100 can then be determined or estimated (step 306).

At step 308, based at least partially upon the free volume 130, down-hole pressures and the perforation gun 100 selected, a target dynamic underbalance may be determined. For example, a magnitude and duration of the dynamic underbalance may be planned to produce clean perforation tunnels in the hydrocarbon producing formation, and to avoid unnecessary damage to the perforating gun or other down-hole equipment. The target dynamic underbalance can be planned using modeling software and techniques recognized in the art. In some exemplary embodiments, determining the target dynamic underbalance comprises calculating an amount of gas that will be necessary to balance the hydrostatic pressure and the formation pressures within the free volume 130

Next, at step 310, at least one solid propellant tablet 150 may be selected and installed to approximate the target dynamic underbalance. In some embodiments, the solid propellant tablet 150 is selected from a variety of solid propellant tablets 150 that are pre-manufactured to have a size, shape and composition such that, upon ignition, the solid propellant tablet 150 releases a predetermined quantity of combustion gasses over a predetermined time frame. In some exemplary embodiments, more than one solid propellant tablet 150 may be selected and installed to produce the amount of gas calculated to balance the down-hole pressures in the free volume 130. Thus, one or more solid propellant tablets 150 may be selected such that the pressure within the free volume 130 may be maintained at a desired pressure below the hydrostatic pressure while the solid propellant tablet 150 is consumed in order to approximate the target dynamic underbalance. In some embodiments, two or more solid propellant tablets 150 may be installed in a perforating gun 100. The two or more solid propellant tablets 150 may be spaced from one another along the detonator cord 140, and may have differing sizes, shapes, and chemical compositions. In some embodiments, a single solid propellant tablet 150 may include two or more distinct chemical compositions arranged to be consumed in a sequential manner. In some exemplary embodiments, a first solid propellant tablet is installed in a first perforating gun 100*a* and a second solid propellant tablet in a second perforating gun 100*d*. The first and second solid propellant tablets 150 may be distinct from one another in size, shape and chemical composition to accommodate for differences in the down-hole pressures determined at the first and second down-hole locations in step 302.

Next, at step 310, the perforating gun(s) 100 may be deployed into wellbore 12 on work string 22, or by another type of conveyance. Once the perforating gun(s) 100 is deployed at the desired perforating location in the wellbore 12, the shaped charges 110 may be detonated (step 314) and the solid propellant tablet 150 or tablets 150 may be ignited by detonating the detonator cord 140. After the initial pressure peak 208 (see FIG. 4) following the detonation of high explosive in the shaped charges 110, the solid propellant tablet(s) 150 will be consumed by combustion or another chemical reaction that yields a release of combustion gasses or other fluid into the free volume 130. The combustion gasses or other fluids in the free volume will raise the pressure within the free volume 130 to disrupt the rapid inflow of wellbore fluids and or formation fluids into the free volume 130. In some embodiments, the combustion gasses or other fluids raise the pressure in the free volume 130 to a desired pressure that is lower than the hydrostatic pressure or formation pressures determined in step 302 during combustion or consumption of the solid propellant tablet(s) 150. Once the solid propellant tablet(s) 150 are fully consumed, the pressure in the free volume 130 may stabilize at the formation pressure 204 (see FIG. 4).

In one aspect, the present disclosure is directed to a method of managing a dynamic underbalance condition resulting from firing a perforating gun at a down-hole location. The method includes (a) determining a free volume in the perforating gun, (b) determining down-hole pressures including a hydrostatic wellbore pressure and a formation pressure at the down-hole location, (c) determining a target dynamic underbalance condition based on the free volume and down-hole pressures; and (d) installing a solid propellant tablet in the free volume, wherein the propellant tablet is selected to have reactive characteristics for increasing a pressure condition in the free volume while maintaining the pressure condition in the free volume below the hydrostatic wellbore pressure during consumption of the solid propellant tablet to thereby approximate the target dynamic underbalance condition.

In some exemplary embodiments, installing the solid propellant tablet in the free volume includes passing a detonator cord through a central aperture defined in the solid propellant tablet. The method may also include deploying the perforating gun to the downhole location, detonating at least one shaped charge within perforating gun, and igniting the solid propellant tablet with the detonator cord to thereby approximate the target dynamic underbalance condition in the wellbore.

In one or more exemplary embodiments, igniting the solid propellant tablet includes initiating a chemical reaction within the central aperture such that the solid propellant tablet is consumed by the chemical reaction in a radially outward direction extending from the central aperture. In some exemplary embodiments, the solid propellant tablet is constructed of an inner propellant material and a distinct outer propellant material concentrically arranged around the central aperture such that igniting the solid propellant tablet includes igniting the inner propellant material and wherein outer propellant material is ignited by the inner propellant material. In one or more exemplary embodiments, the method further includes pre-manufacturing the solid propellant tablet in a generally cylindrical shape from a powdered metal blend held together with binder material.

In some exemplary embodiments, determining the target dynamic underbalance condition comprises calculating a quantity of gas to be produced in the free volume to balance the hydrostatic wellbore pressure and the formation pressure. The method may further include selecting a size, shape and composition of the solid propellant tablet to produce the quantity of gas.

In another aspect, the present disclosure is directed to a wellbore pressure control assembly for use during a perforating operation in a wellbore. The wellbore pressure control assembly includes a carrier body and at least one shaped charge disposed within the carrier body. The at least one shaped charge includes a high explosive. The wellbore pressure control assembly further includes at least one solid propellant tablet disposed in a free volume within the carrier body. The at least one solid propellant tablet includes a central aperture therein defining an ignition point for a chemical reaction which causes an increase in pressure within the free volume to maintain an underbalanced condition the wellbore upon detonation of the shaped charge and ignition of the solid propellant tablet.

In one or more exemplary embodiments, the wellbore pressure control assembly further includes a detonator cord extending into the central aperture and operably coupled to the shaped charge for detonating the high explosive. In some exemplary embodiments, the solid propellant tablet is constructed of a material selected from the group consisting of zinc, aluminum, bismuth, tin, calcium, cerium, cesium, hathium, iridium, lead, lithium, palladium, potassium, sodium, magnesium, titanium, zirconium, cobalt, chromium, iron, nickel, tantalum, depleted uranium and combination, alloys, carbides and hydrides of these materials.

In some exemplary embodiments, the solid propellant tablet is constructed in a generally cylindrical shape from a powdered metal blend held together with a binder material. In some embodiments, the solid propellant tablet includes an inner propellant material disposed about the central aperture and a distinct outer propellant material disposed about the inner propellant material. In one or more exemplary embodiments, the generally cylindrical shape is a disc shape such that a diameter of the solid propellant tablet is greater than a height of the solid propellant tablet.

In another aspect, the present disclosure is directed to a method of providing a perforating gun assembly for use during a perforating operation in a wellbore. The method includes (a) determining down-hole pressures including a hydrostatic wellbore pressure and a formation pressure at a down-hole location, (b) selecting at least one perforating gun, the perforating gun comprising a carrier body and at least one charge disposed within the carrier body, wherein the at least one charge includes a high explosive, (c) subsequent to selecting the at least one perforating gun, determining a target dynamic underbalance based on a free volume defined within the carrier body of the at least one perforating gun and based on the down hole pressures determined, and (d) subsequent to determining the target dynamic underbalance, installing at least one solid propellant tablet in the free volume in the carrier body of the at least one perforating gun, wherein the solid propellant tablet is selected to have reactive characteristics for increasing a pressure condition in the free volume while maintaining the pressure condition in the free volume below the hydrostatic wellbore pressure to thereby approximate the target dynamic underbalance condition.

In one or more exemplary embodiments, installing the solid propellant tablet comprises coupling a detonator cord to a central aperture defined in solid propellant tablet. In some exemplary embodiments, installing at least one solid propellant tablet includes installing first and second solid propellant tablets that are distinct from one another in at least one of size, shape and chemical composition. In some embodiments, selecting at least one perforating gun comprises selecting first and second perforating guns, and installing the first and solid second propellant tablets comprises installing the first solid propellant tablet in the first perforating gun and the second solid propellant tablet in the second perforating gun.

In some exemplary embodiments, determining down-hole pressures includes determining down-hole pressures at first and second down-hole locations. In some embodiments, installing at least one solid propellant tablet includes installing a first solid propellant tablet in a first perforating gun and a second solid propellant tablet in a second perforating gun, wherein the first and second solid propellant tablets are distinct from one another in at least one of size, shape and chemical composition to accommodate for differences in the down-hole pressures determined at the first and second down-hole locations.

In another aspect, the disclosure is directed to a method of mitigating a dynamic underbalance generated by perforating a geologic formation. The method includes (a) conveying a perforating gun into a wellbore, (b) generating a dynamic underbalanced condition in the wellbore by detonating a perforating charge within the perforating gun, and (c) releasing a pressurized fluid into the wellbore by igniting a solid propellant within the perforating gun.

In some exemplary embodiments, releasing the pressurized fluid includes igniting the solid propellant from a central aperture formed therein.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A method of managing a dynamic underbalance condition resulting from firing at least one shaped charge of a perforating gun at a down-hole location, comprising:

(a) determining a free volume in the perforating gun;

(b) determining down-hole pressures including a hydrostatic wellbore pressure and a formation pressure at the down-hole location;

(c) determining a target dynamic underbalance condition based on the free volume and down-hole pressures;

(d) installing a solid propellant tablet in the free volume distinct and spaced from the at least one shaped charge, wherein the propellant tablet is constructed of a propellant material arranged in a solid geometry circumscribing a central aperture defined in the solid propellant tablet, the propellant material selected to have reactive characteristics for increasing a pressure condition in the free volume while maintaining the pressure condition in the free volume below the hydrostatic wellbore pressure during consumption of the solid propellant tablet to thereby approximate the target dynamic underbalance condition; and (e) operably coupling an ignitor to the central aperture defined in the solid propellant tablet.

2. The method of claim 1, wherein operably coupling the ignitor to the central aperture comprises passing a detonator cord through the central aperture defined in the solid propellant tablet.

3. The method of claim 2, further comprising:

deploying the perforating gun to the downhole location;

detonating at least one shaped charge within perforating gun; and igniting the solid propellant tablet with the detonator cord to thereby consume the solid propellant tablet generally radially outwardly from the central aperture approximate the target dynamic underbalance condition in the wellbore.

4. The method of claim 3, wherein igniting the solid propellant tablet comprises initiating a chemical reaction within the central aperture such that the solid propellant tablet is consumed by the chemical reaction in all radially outward directions extending from the central aperture.

5. The method of claim 4, wherein the solid propellant tablet is constructed of an inner propellant material and a distinct outer propellant material concentrically arranged around the central aperture such that igniting the solid propellant tablet comprises igniting the inner propellant material and wherein outer propellant material is ignited by the inner propellant material.

6. The method of claim 1, further comprising pre-manufacturing the solid propellant tablet in a generally cylindrical shape from a powdered metal blend held together with binder material.

7. The method of claim 1, wherein determining the target dynamic underbalance condition comprises calculating a quantity of gas to be produced in the free volume to balance the hydrostatic wellbore pressure and the formation pressure.

8. The method of claim further comprising selecting a size, shape and composition of the solid propellant tablet to produce the quantity of gas.

9. A wellbore pressure control assembly for use during a perforating operation in a wellbore, the wellbore pressure control assembly comprising:

a carrier body;

at least one shaped charge disposed within the carrier body wherein the at least one shaped charge includes a high explosive;

at least one solid propellant tablet disposed in a free volume within the carrier body and substantially spaced from the at least one shaped charge, the at least one solid propellant tablet including a propellant material arranged in a solid geometry circumscribing a central aperture defined therein, the central aperture defining an ignition point for a chemical reaction which causes an increase in pressure within the free volume; and an ignitor operably coupled to the central aperture of the solid propellant tablet to ignite the propellant material to cause the solid propellant tablet to be consumed radially outward from the central aperture.

10. The wellbore pressure control assembly of claim 9, wherein the ignitor comprises a detonator cord extending into the central aperture and operably coupled to the shaped charge for detonating the high explosive.

11. The wellbore pressure control assembly of claim 10, wherein central aperture is disposed immediately adjacent the detonator cord such that the solid geometry extends radially outwardly from the detonator cord to an outer radial perimeter of the solid propellant tablet.

12. The wellbore pressure control assembly of claim 9, wherein solid propellant tablet is constructed of a material selected from the group consisting of zinc, aluminum, bismuth, tin, calcium, cerium, cesium, hathium, iridium, lead, lithium, palladium, potassium, sodium, magnesium, titanium, zirconium, cobalt, chromium, iron, nickel, tantalum, depleted uranium and combination, alloys, carbides and hydrides of these materials.

13. The wellbore pressure control assembly of claim 9, wherein the solid propellant tablet is constructed in a generally cylindrical shape from a powdered metal blend held together with a binder material.

14. The wellbore pressure control assembly of claim 13, wherein the solid propellant tablet comprises an inner propellant material disposed about the central aperture and a distinct outer propellant material disposed about the inner propellant material.

15. The wellbore pressure control assembly of claim 13, wherein the generally cylindrical shape is a disc shape such that a diameter of the solid propellant tablet is greater than a height of the solid propellant tablet.

16. A method of providing a perforating gun assembly for use during a perforating operation in a wellbore, the method comprising:

(a) determining down-hole pressures including a hydrostatic wellbore pressure and a formation pressure at a down-hole location;

(b) selecting at least one perforating gun, the perforating gun comprising a carrier body and at least one charge disposed within the carrier body, wherein the at least one charge includes a high explosive;

(c) subsequent to selecting the at least one perforating gun, determining a target dynamic underbalance based on a free volume defined within the carrier body of the at least one perforating gun and based on the down hole pressures determined; and (d) subsequent to determining the target dynamic underbalance, installing at least one solid propellant tablet in the free volume in the carrier body of the at least one perforating gun, wherein the solid propellant tablet is selected to have reactive characteristics for increasing a pressure condition in the free volume while maintaining the pressure condition in the free volume below the hydrostatic wellbore pressure to thereby approximate the target dynamic underbalance condition; wherein installing at least one solid propellant tablet comprises installing first and second solid propellant tablets that are distinct from one another in at least one of size, shape and chemical composition.

17. The method of claim 16, wherein installing the solid propellant tablet comprises coupling a detonator cord to a central aperture defined in solid propellant tablet.

18. The method of claim 16, wherein selecting at least one perforating gun comprises selecting first and second perforating guns, and installing the first and solid second propellant tablets comprises installing the first solid propellant tablet in the first perforating gun and the second solid propellant tablet in the second perforating gun.

19. The method of claim 16, wherein determining down-hole pressures comprises determining down-hole pressures at first and second down-hole locations.

20. The method of claim 19, wherein installing at least one solid propellant tablet comprises installing a first solid propellant tablet in a first perforating gun and a second solid propellant tablet in a second perforating gun, wherein the first and second solid propellant tablets are distinct from one another in at least one of size, shape and chemical composition to accommodate for differences in the down-hole, pressures determined at the first and second down-hole locations.

* * * * *